United States Patent [19]

Cummings et al.

[11] 4,295,461

[45] Oct. 20, 1981

[54] FRICTION HEAT GENERATOR APPARATUS

[76] Inventors: J. Francis Cummings, 35155 Chardon Rd., Willoughby Hills, Ohio 44094; Alfred O. Werner, 194 Hawthorn Dr., Painesville, Ohio 44077

[21] Appl. No.: 105,131

[22] Filed: Dec. 19, 1979

[51] Int. Cl.[3] ..... F24C 9/00

[52] U.S. Cl. ..... 126/247; 122/26

[58] Field of Search ..... 122/26, 27, 28; 126/247

[56] References Cited

U.S. PATENT DOCUMENTS

| | | | |
|---|---|---|---|
| 1,650,612 | 11/1927 | Denniston | 122/26 |
| 1,919,681 | 7/1933 | Anderson | 126/247 |
| 2,251,344 | 8/1941 | Tesch | 122/26 |
| 2,344,075 | 3/1944 | Beldimano | 126/247 |
| 2,625,929 | 1/1953 | Love et al. | 122/26 |
| 3,164,147 | 1/1965 | Love et al. | 126/247 |
| 3,198,176 | 8/1965 | Helmer | 122/26 |
| 3,198,191 | 8/1965 | Wyszomirski | 126/247 |
| 3,402,702 | 9/1968 | Love | 122/26 |

*Primary Examiner*—Henry C. Yuen

*Attorney, Agent, or Firm*—Watts, Hoffmann, Fisher & Heinke Co.

[57] ABSTRACT

The present invention is directed generally to heating systems, and more particularly to a new and improved friction heat generator apparatus for converting electrical energy into heat without the use of fossil fuels. The heat generator apparatus comprises a housing which interiorly mounts a heat exchange unit which contains a heat transfer medium (i.e. water) and a fly-force friction drive unit mounted for rotation with a drive shaft for frictionally engaging said heat exchange unit in response to centrifugal force imparted to a fly-weight mechanism upon rotational movement of the drive shaft to provide a rapid and efficient development and transfer of heat to the heat transfer medium for various heating applications.

10 Claims, 7 Drawing Figures

FRICTION HEAT GENERATOR APPARATUS

BACKGROUND OF THE INVENTION

The present invention relates to improvements in the friction heat generator of the type which produces heat by relative movement between parts which are brought into frictional engagement. The present invention is more specifically related to the use of a unique fly-force-friction drive mechanism for imparting heat by friction to a heat transfer medium contained within a heat exchange unit due to the influence of centrifugal force brought about by rotational movement of a drive shaft powered by a suitable source of electrical power. This drive mechanism includes a cam and fly-weight arrangement which operably coact to transfer rotational movement of the drive shaft into linear movement of a drive member for bringing rotational members into frictional engagement with non-rotational members to effect a rapid and efficient development in transfer of heat to the heat transfer medium within the heat exchange unit for the purpose of heating or the like.

Heretofore, various devices have been contemplated to heat water by mechanical means, such as by a friction element rotating against another element in a boiler or the like. Such devices are illustrated, for example in U.S. Pat. Nos. 1,650,612, 2,251,344, 2,625,929, 3,198,176 and 3,402,702.

With the present energy crises resulting from the reduced supply of fossil fuels, such as oil, gas or coal, there is a need for an efficient means for converting electrical energy into heat. It is heretofore been thought that the oil reserves on this earth were vast so that heat energy from this source would be no problem. However, it is now been recognized that there has been a severe reduction in supply of such natural resources to serve man's needs. Indeed, it is recognized that it is impossible to convert energy from one single form to another without an energy loss. Accordingly, it is the purpose of the present invention to utilize the maximum amount of heat energy from electricity, steam, water, hydro-electric or the like with a minimum of loss without the need to rely on fossil type fuels.

The present invention has application to a wide variety of uses including but not limited to domestic home heating, commercial and industrial heating, locomotion and others. For example, the friction heat generator apparatus of the invention may be employed with automotive type radiators and fans for use as flameless portable, hot-air space heaters or the like.

The present invention is intended and adapted to overcome the difficulties and disadvantages in prior heating systems, it being one of the objects to provide a new and improved friction heat generator apparatus which can be readily and easily employed in a heating system in which electricity, steam, water, hydroelectric power are utilized with a substantially higher recovery of heat produced than in prior electrical immersion heaters, for example. Specifically, the present invention enables the heat exchange medium (i.e. water) to be brought into contact with a much greater heat transfer area as compared to electrical immersion type heaters presently available on the market.

SUMMARY OF THE INVENTION

A friction heat generator apparatus comprising an outer housing having fluid inlet and outlet ports with a drive shaft journaled for rotational movement within the housing. A heat exchange unit is mounted on the drive shaft and includes a heat exchange chamber containing a heat transfer medium communicating with the inlet and outlet ports for distribution to a heating system. A conductor plate member is attached to the heat exchange unit for frictional engagement by a fly-force-friction drive mechanism upon rotational movement of the drive shaft. The friction drive mechanism includes a drive hub member keyed to the drive shaft and a friction drive shoe member operably mounted for axial movement on the drive shaft for frictional engagement with the conductor plate upon pivotal movement of a fly-weight unit which drives a drive pin member upon rotational movement of the drive shaft due to the influence of centrifugal force resulting from pivotal movement of the fly-weight unit.

In the invention, the fly-weight unit is resiliently mounted and includes a cam element for translating pivotal (rotational) movement into linear movement for bringing the drive shoe member into frictional engagement with the conductor plate member for the development of heat to be transferred to the heat transfer medium (i.e. water) contained within the heat exchange unit. In the invention, the housing contains a lubricating fluid (i.e. oil) which communicates the grooves provided in the drive shoe member for reducing wear on the conductor plate members.

In the invention, it will be seen that in the preferred embodiment there is illustrated one heat exchange unit and two of the novel fly-force friction drive mechanisms disposed on either side thereof for rotational movement with the drive shaft. It will be understood, however, that any number of heat exchange units may be employed on the drive shaft in conjunction with any number of friction drive mechanisms, as desired.

In the following drawings, there is illustrated a preferred embodiment of the invention and such embodiment will be described, but it will be understood that various changes may be made from the construction illustrated, and that the drawings and description are not to be construed as defining or limiting the scope of the invention.

DESCRIPTION OF THE PREFERRED EMBODIMENT

Figure 1:
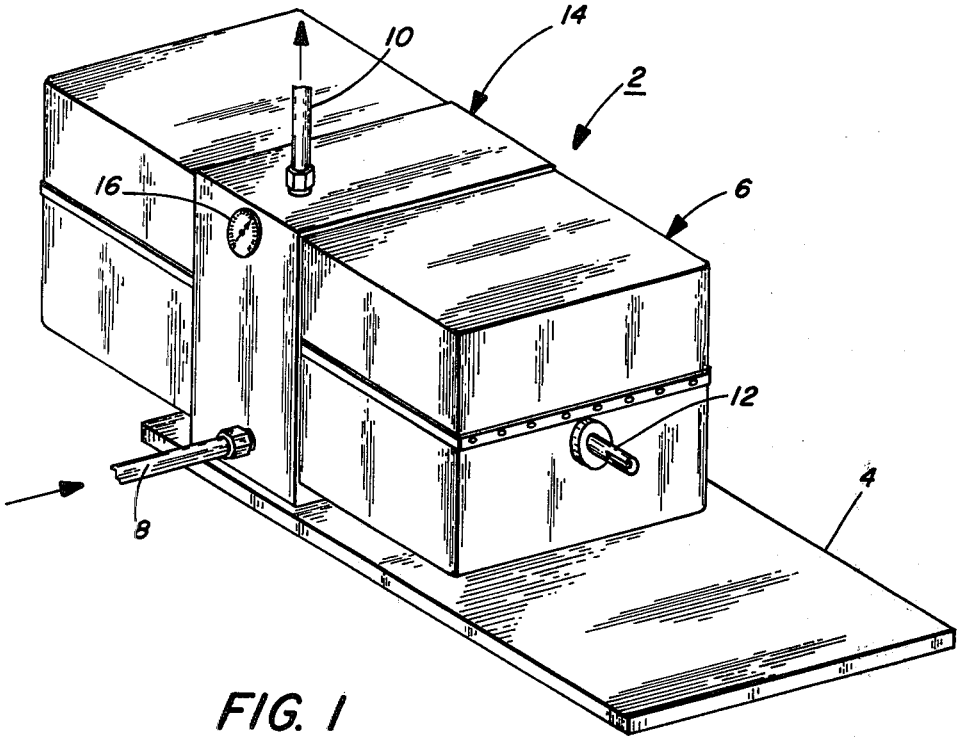
FIG. 1 is a generally perspective view showing generally the friction heat generator apparatus of the present invention.

Referring now again to the drawings and in particular to FIG. 1, there is illustrated the novel of friction heat generator, designated generally at 2, of the present invention. In the embodiment shown, the apparatus may be mounted on any suitable support member, as at 4, and includes an outer hollow housing preferably of polygonal, such as rectangular configuration. The housing, designated generally at 6, includes an inlet port 8 for delivery of a medium to be heated, such as water, and an outlet port 10 for delivery to a heating system, such as a radiator or the like. As shown, a drive shaft extends horizontally into the housing 6 and may be driven by a suitable source of power, such as an electric motor or the like (not shown) in a manner as known in the art. The housing 6 mounts a generally centrally oriented heat exchange unit, designated generally at 14, which may incorporate a conventional type pressure and/or heat gage 16 for monitoring the pressure and heat conditions within the heat exchange unit.

Figure 2:
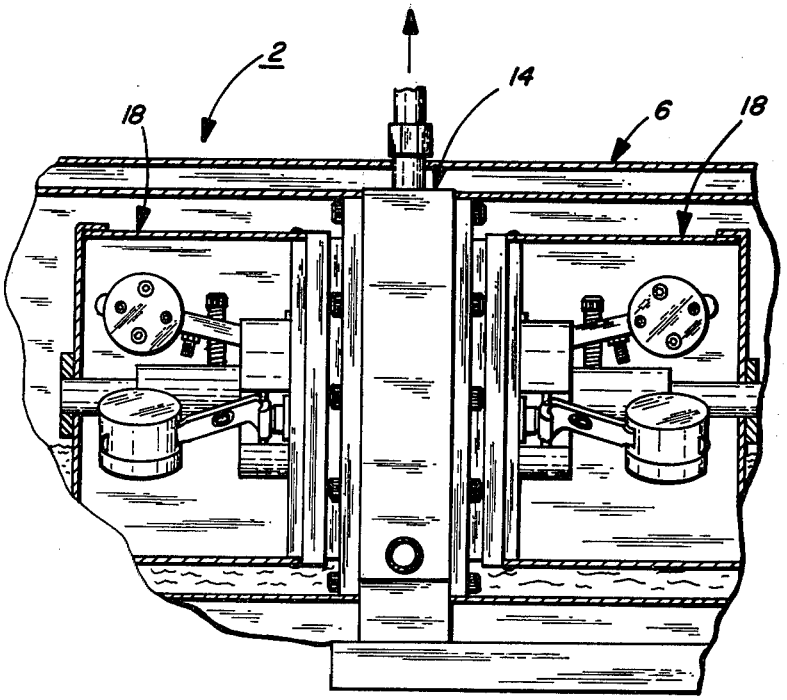
FIG. 2 is a fragmentary, generally horizontal section view taken through the friction heat generator apparatus of FIG. 1.

As best seen in FIG. 2, the apparatus 2 in the embodiment illustrated, includes the heat exchange unit 14 and a pair of oppositely disposed fly-force-friction drive mechanisms, designated generally at 18, mounted within the housing 6 for frictional engagement with the heat exchange unit 14. The mechanisms 18 are of identical construction so that the following description will proceed with reference to reference numerals which designate like parts.

Accordingly, the heat exchange unit 14 includes an outer plate 20 (FIG. 3) and a pair of oppositely disposed polygonal conductor plates 22 and 24 which may be sealed together, as at 26, by water sealed gaskets (oil resistant) to provide a heat exchange chamber for containing a heat transfer medium, such as water or the like therein. The heat exchange unit includes side plates 28 having a plurality of horizontally disposed ribs 30 to maximize the heat transfer characteristics of the unit. The unit includes a central core member 32 mounted via roller bearings 31 in rotation on the drive shaft 12. The core 32 is mounted by a bearing assembly 34 which includes bearings 33 fixed to the shaft 12 and bearings 35 fixed to the core 32 and by the rollers 31 to allow rotation of the unit 14 and conductor plates 22 and 24 with the shaft 12. The drive shaft 12 may be journaled, as at 13, to the housing 6 and may be provided with oil seals, as at 15, so as to maintain a fluid seal in respect to a lubricant, such as oil, contained within the housing 6, as best illustrated at 17 in FIG. 3.

As shown, the core member 32 includes a pair of silicone-"O"-rings 36 which provide a sealing engagement with the respect of conductor plate members 22 and 24 so as to prevent the heat transfer medium from communicating with the lubricant contained within the housing.

In the invention, all of the components of the heat exchange unit 14 are made from aluminum including the conductor plates 22 and 24 to maximize the heat transfer developed to the heat transfer medium. It is to be understood, however, that other good heat conductive materials may be employed in accordance with the invention.

Now in accordance with the invention, the fly-force-friction drive mechanism (2 illustrated), which is designated at 18, comprises a drive hub 40 which is keyed, as at 42, to the drive shaft 12 for rotation therewith. The hub member 40 includes an integral flange 44 (FIG. 3) which mounts a drive plate member 46 which is connected to an inner splash control chamber 48 which is fixed for rotation with the drive shaft 12. The drive plate member 46 may be provided with gasket seals, as at 50, to prevent the ingress of lubricant into the interior of the chamber 48.

Figure 3:
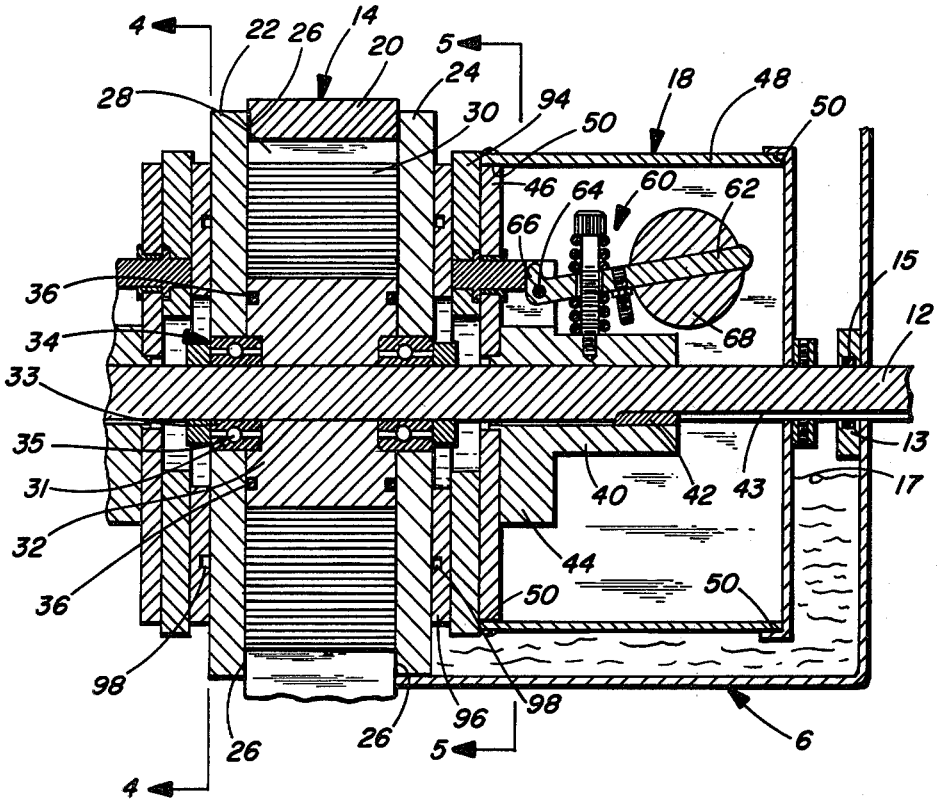
FIG. 3 is a fragmentary, generally vertical section view, with parts broken away (on an enlarged scale taken through FIG. 2.
Figure 4:
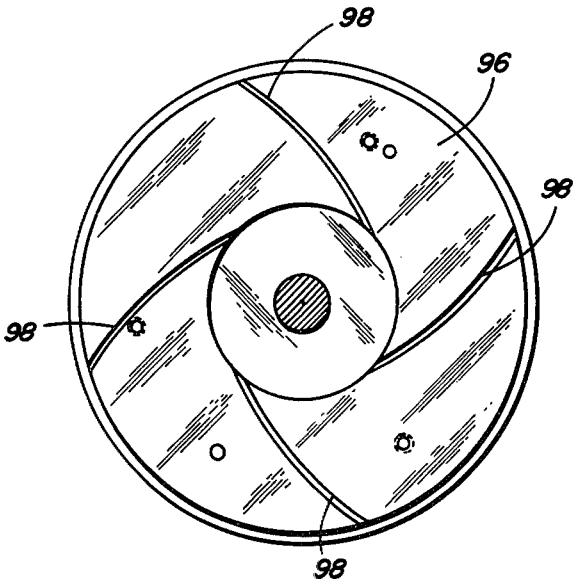
FIG. 4 is a vertical section view taken along the line 4—4 of FIG. 3.
Figure 6:
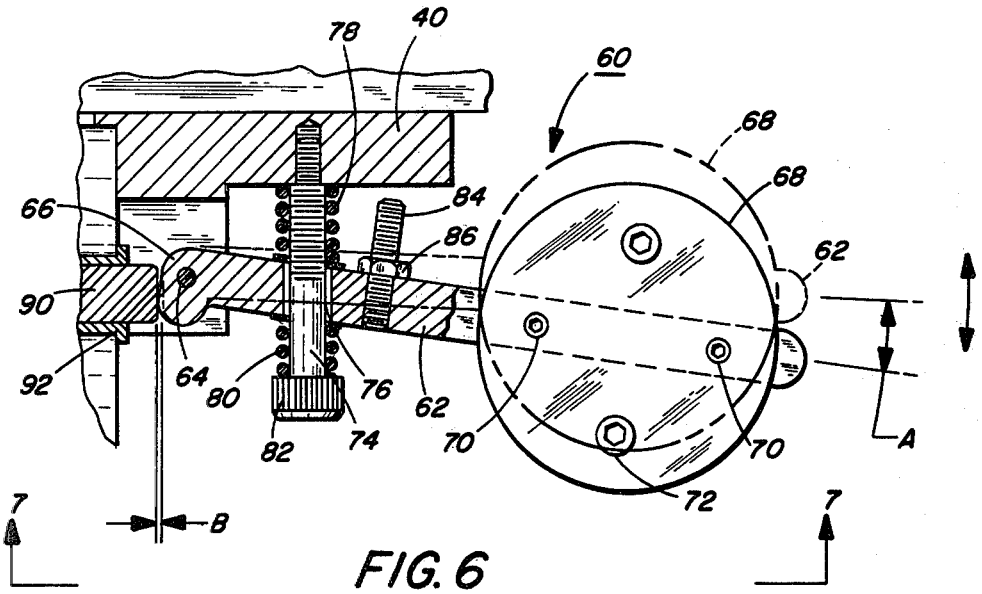
FIG. 6 is an enlarged, fragmentary section view with parts broken away illustrating the novel fly-weight mechanism of the invention.
Figure 7:
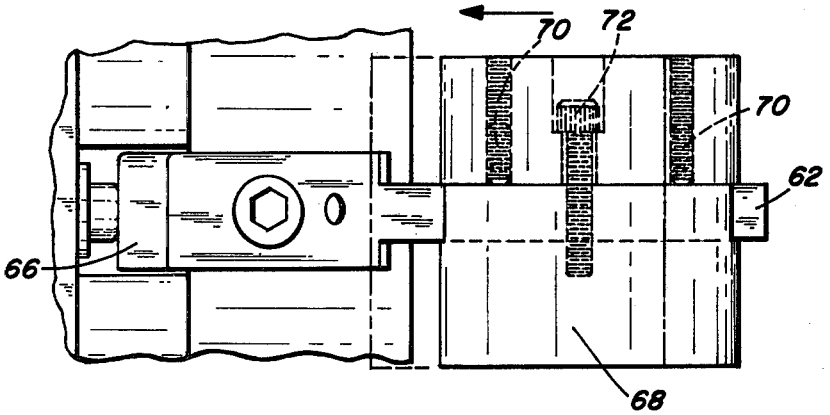
FIG. 7 is a fragmentary, bottom view looking in the direction of line 7—7 of FIG. 6.

In accordance with the invention, there is provided a novel fly-weight mechanism, designated generally at 60, operably mounted for pivotal movement on the hub member 40. As shown, the mechanism 60 includes a cam arm 62 which is pivotally mounted, as at 64, to the flange 44, as best illustrated in FIGS. 3 and 6. The cam arm 62 includes a cam element 66 of curved configuration at one end and mounts at its other end a fly-weight element 68. The fly-weight element 68, in the embodiment shown, is preferably of a solid ball construction having the desired size and weight for imparting the desired predetermined pressure for development of the necessary friction to be transferred to the heat exchange unit. As best seen in FIGS. 6 and 7, the fly-weight element may be axially adjustable on the arm 62 via set screws 70 and cap screws 72 as desired. In FIG. 6 there is illustrated in dotted line the pivotal movement of the cam arm 62 about pivot point 64 and the corresponding pivotal movement of the fly-weight element 68. For example, the relative pivotal movement is illustrated by the angle A and the clearance distance on the cam surface 66 by the distance B.

In the invention, a snubber post 74 is threadably attached to the hub member 40 and extends through an aperture 76 provided in the arm 62. A pair of snubber compression springs 78 and 80 are disposed around the post 74 for biasing engagement between the hub member 40 and the arm 62 and the arm 62 and the head of the post, respectively. By this arrangement, the arm 62 mounting the fly-weight element 68 are mounted for resilient pivotal movement in relation to the hub member 40. As shown, an adjustable stop element 84 may be provided which is threaded to receive a lock nut 86 to provide a positive stop for limiting pivotal movement of the fly-weight element 68 in a radial direction toward the drive shaft 12.

Now in the invention, a drive pin member 90 extends through a wear bushing 92 inserted through the drive plate member 46 and is mounted flush within a carrier plate member 94 (FIG. 3) which mounts a drive shoe member 96. Accordingly, by this arrangement upon pivotal movement of the cam arm 62 by the fly-weight element 68 upon rotation of the drive shaft 12, the arm 66 pivots inwardly toward the drive shaft about the pivot point 64 so as to drive the pin member 90 axially inwardly through the plate member 46 for pushing the carrier plate member 94 and the friction shoe member 96 into frictional engagement with the confounding surface of the conductor plate member 24. It will be seen, therefore, that the pin 90, plate 94 and shoe 96 members are, in effect, joined together for unitary movement relative to the drive plate member 46 which defines the inner wall of the splash chamber 48.

In the invention, the carrier plate member 94 may be made of steel and the friction shoe element of a good friction material, such as cast meehanite or the like. In the invention, the shoe member 96 is provided with a plurality, such as 4, symmetrically arranged grooves which communicate with the lubricating oil 17 in the oil chamber of the housing so as to lubricate the friction surfaces between the conductor plate 24 and the friction shoe member 96.

Figure 5:
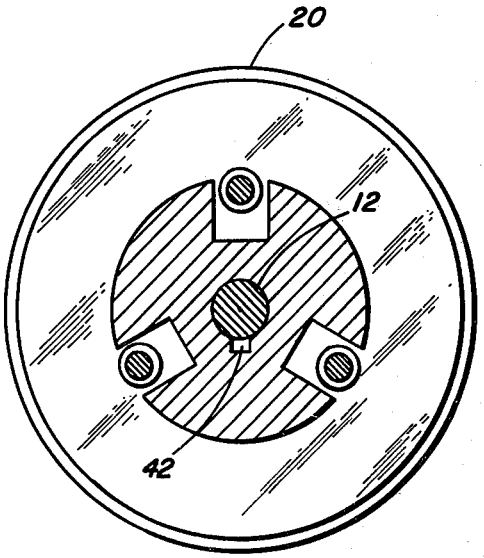
FIG. 5 is a vertical section view taken along the line 5—5 of FIG. 3.

In the invention, it will be understood that suitable insulation (not shown) such as a jacket or the like may be provided around or interiorly of the housing 14 to maximize the heat transfer characteristics of the apparatus. Also, any suitable motive means, such as a recirculating pump or the like, may be utilized for forcing the heat transfer medium through the heat exchange unit and/or for recirculating the same, as desired. Accordingly, in the invention, only one heat exchange unit and fly-force friction drive mechanism have been illustrated, it will be understood that in a preferred form one such heat exchange unit is employed with two such drive mechanisms utilized in parallel on either side of the heat exchange unit, as illustrated in FIG. 2. In this case, each drive mechanism would include, therefore, three of the novel fly-weight mechanism symmetrically arranged about the longitudinal central axis of the apparatus in relation to the drive shaft 12, as best illustrated in FIG. 5. It has been found, that this particular arrangement provides superior results in developing an efficient uniform centrifugal force developed by the fly-weight elements 68 which is converted into linear (axial) force via the cam arm 66 and drive pin member 90 for bringing the friction shoe members into frictional engagement with the confronting surfaces of the respective conductor plates disposed on either side of the heat exchange unit.

What is claimed is:

1. A friction heat generator apparatus comprising, a. an outer housing having a fluid inlet and outlet means, b. a drive shaft journaled for rotative movement within said housing, c. a heat exchange means mounted on said drive shaft, d. said heat exchange means including a heat exchange chamber containing a heat transfer medium communicating with said inlet and outlet means, e. a non-rotatable conductor plate member attached to said heat exchange means, f. fly-force-friction drive means mounted for rotation with said drive shaft, g. said friction drive means including a drive hub member connected to said drive shaft, h. a friction drive shoe assembly operably mounted for axial movement relative to said drive hub member, i. a fly-weight mechanism mounted for resilient pivotal movement on said drive hub member, and j. said fly-weight mechanism including cam means operably connected to said friction drive shoe assembly for frictionally engaging said conductor plate member upon rotation of said drive shaft.

2. A friction heat generator apparatus in accordance with claim 1, including a drive shoe carrier member mounting said friction drive shoe member.

3. A friction heat generator apparatus in accordance with claim 1, including a splash control chamber disposed around said friction drive means for rotation with said drive shaft.

4. A friction heat generator apparatus in accordance with claim 3, including a lubricating medium disposed in said housing and exteriorly of said control chamber.

5. A friction heat generator apparatus in accordance with claim 1, wherein said friction drive means includes a cam arm pivotally mounted on said drive hub member, a. said cam arm having a cam surface at one end and a fly-weight member at the other end, and b. resilient spring means disposed between said cam surface and said fly-weight member for resiliently mounting said fly-weight member upon rotation of said drive shaft.

6. A friction heat generator apparatus in accordance with claim 5, including adjustable stop means operably associated with said cam arm for limiting pivotal movement of said cam arm relative to said drive hub member.

7. A friction heat generator apparatus in accordance with claim 5, wherein said fly-weight member is axially adjustable on said cam arm.

8. A friction heat generator apparatus in accordance with claim 5, including a drive shoe carrier member mounting said friction drive shoe member, a. drive pin means connected to said drive shoe carrier member;

b. and operably associated with said cam surface on said cam arm for frictionally driving said drive shoe member into frictional engagement with said conductor plate member upon rotation of said drive shaft and pivotal movement of said fly-weight member in response to centrifugal force thereof.

9. A friction heat generator apparatus in accordance with claim 3, wherein said friction drive shoe member includes a plurality of grooves adapted for communication with said lubricating medium to reduce frictional wear on said conductor plate member.

10. A friction heat generator apparatus comprising, a. an outer hollow housing having fluid inlet and outlet means, b. a drive shaft journaled for rotative movement within said housing, c. a heat exchange means mounted on said drive shaft interiorly of said housing, d. said heat exchange means including a heat exchange chamber containing a heat transfer medium communicating with said inlet and outlet means, e. a conductor plate member attached to said heat exchange means and said housing for non-rotation relative to said drive shaft, f. fly-force-friction drive means mounted for rotation with said drive shaft, g. said friction drive means including a drive hub member connected to said drive shaft, h. a friction drive shoe member operably mounted for axial movement on said drive hub member, i. a fly-weight unit mounted for resilient pivotal movement on said drive hub member, and j. said fly-weight member including cam means operably connected to said friction drive shoe member for frictionally engaging said conductor plate member upon rotation of said drive shaft in response to centrifugal force imparted to said fly-weight unit.

* * * * *